US007861629B2

(12) United States Patent
Brander et al.

(10) Patent No.: US 7,861,629 B2
(45) Date of Patent: Jan. 4, 2011

(54) ARTICLE SLICING METHOD AND APPARATUS

(75) Inventors: William M. Brander, Douglasville, GA (US); Ivan Stanojevic, Atlanta, GA (US)

(73) Assignee: Maxwell Chase Technologies, LLC, Atlanta, GA (US)

( * ) Notice: Subject to any disclaimer, the term of this patent is extended or adjusted under 35 U.S.C. 154(b) by 646 days.

(21) Appl. No.: 10/943,385

(22) Filed: Sep. 17, 2004

(65) Prior Publication Data

US 2006/0021484 A1 Feb. 2, 2006

Related U.S. Application Data

(60) Provisional application No. 60/592,970, filed on Jul. 30, 2004.

(51) Int. Cl.
*B26D 1/00* (2006.01)
*B26D 3/00* (2006.01)

(52) U.S. Cl. ..... 83/27; 83/102; 83/112; 83/167; 83/431; 83/932

(58) Field of Classification Search ..... 83/112, 83/150, 153, 154, 13, 932, 874, 858, 865, 83/431, 435.15, 425.3, 102, 27, 648, 167; 426/482, 484, 518, 558; 99/537–539, 485
See application file for complete search history.

(56) References Cited

U.S. PATENT DOCUMENTS

| | | | | | |
|---|---|---|---|---|---|
| 1,999,449 | A | * | 4/1935 | Erickson | 83/751 |
| 2,219,963 | A | * | 10/1940 | Rieder | 83/167 |
| 2,236,176 | A | * | 3/1941 | Jagenburg | 83/418 |
| 2,280,059 | A | | 4/1942 | Brustowsky | 146/158 |
| 2,661,039 | A | * | 12/1953 | Davis et al. | 99/513 |
| 2,989,104 | A | * | 6/1961 | Good | 83/77 |
| 3,161,215 | A | * | 12/1964 | Werder et al. | 83/81 |
| 3,258,046 | A | * | 6/1966 | Lackerman | 83/751 |
| 3,948,132 | A | | 4/1976 | Camp | 83/425.3 |
| 4,062,260 | A | * | 12/1977 | Steinhogl | 83/404.3 |
| 4,184,397 | A | | 1/1980 | Jones | 83/874 |

(Continued)

FOREIGN PATENT DOCUMENTS

| | | |
|---|---|---|
| GB | 600131 | 4/1948 |

OTHER PUBLICATIONS

English translation of Japanese Office Action of Oct. 14, 2008 in Japanese Patent Application 2005-134151 filed May 2, 2005, 3 pages.

*Primary Examiner*—Laura M. Lee
(74) *Attorney, Agent, or Firm*—Thomas, Kayden, Horstemeyer & Risley, LLP

(57) ABSTRACT

Tomatoes are placed on cutting blades (20) in article openings (46) of an article positioning plate (44). The blades are moved as article pushers (24) move downwardly and engage the upper facing surfaces of the tomatoes, pushing the tomatoes through parallel cutting blades (20). The end slices (30 and 40) are gathered in end collectors (96) and discarded while the intermediate slices (42) are received in transfer tray (72). Gathering plates (100) urge the intermediate slices of the several tomatoes to gather in one accumulation of tomato slices, and the transfer tray (72) is lowered to a position immediately above shipping containers (74) and tilted to deposit the tomatoes in the containers.

12 Claims, 7 Drawing Sheets

U.S. PATENT DOCUMENTS 4,405,186 A * 9/1983 Sandberg et al. ..... 414/21
4,856,398 A 8/1989 Kruse et al. ..... 83/425
4,985,268 A 1/1991 Bingham ..... 426/482
5,787,776 A * 8/1998 Nishimoto ..... 83/76.7
6,799,496 B2 * 10/2004 Verhaeghe ..... 83/167
2002/0170398 A1 11/2002 Verhaeghe ..... 83/13
2003/0123968 A1 * 7/2003 Derenthal et al. ..... 414/790

* cited by examiner

ARTICLE SLICING METHOD AND APPARATUS

This application claims the benefit of U.S. Provisional Application 60/592,970, filed Jul. 30, 2004.

FIELD OF THE INVENTION

This invention concerns a method and apparatus for simultaneously cutting several articles into parallel slices, discarding the ends of the articles, gathering the intermediate slices from the several articles together in an accumulation of articles, and depositing the articles in an awaiting shipping tray. More particularly, the method and apparatus concerns the slicing of fruits and vegetables, such as ripe tomatoes, with such gentle care as to reduce the bruising and loss of juice from the slices of tomatoes.

BACKGROUND OF THE INVENTION

When a restaurant is to serve sliced food items, such as sliced tomatoes, a substantial amount of preparation time would be required at the restaurant to slice and otherwise prepare the sliced products. After the food products are purchased and delivered to the restaurant, they would have to be cleaned, sliced, and made available for placement on the salad, sandwich, or other menu item. It is somewhat difficult for the person slicing the food items to prepare slices of uniform width and consistency and there is a substantial amount of waste because of improper slicing, etc.

In the instance of fast food restaurant chains, the owners of the restaurant chain usually desires to present a uniform food product, such as hamburger of uniform size, appearance and taste, with tomatoes applied to the hamburger, and with the hamburgers and all of its ingredients being substantially identical from one restaurant to another. It has become important that tomatoes, in particular, be sliced to a desired thickness when placed on sandwiches, salads etc. of a restaurant of a chain of fast food restaurants. This provides the customer with confidence that the food products will be uniform from one restaurant to the other within the chain of restaurants. Accordingly, restaurant managers now prefer to receive food items in proper condition for placement on a sandwich, salad, etc., for immediate service to the customer without preparation steps such as slicing the food products.

Various prior art slicing machines have been prepared for the purpose of slicing food products. It is desirable that slicers of articles, such as tomatoes, function rapidly, uniformly, efficiently, and with enough gentle care to not damage the food products, and with the ability to deliver the food products in a handy, attractive condition. For example, it is desirable that tomatoes be sliced and packaged with such gentle care that the juices of the tomato are substantially maintained in the tomato slices, not exuded from the tomato, and that the circular shape of the perimeter of the tomato be maintained without any discernible bruising or other damage.

By cutting tomatoes in slices of uniform thickness, a force is applied by the cutting implements to the tomato, tending to squeeze or otherwise collapse the tomato during the slicing function. In addition, there usually is a phase in the slicing and packaging operation where the sliced tomatoes are dropped from one operation toward another operation during which there is a hazard that the tomato slices will loose their juices and that the slices will become tilted or otherwise misaligned with one another, creating non-uniformity of the product in the shipping tray or other package of sliced tomatoes.

For most food items to be sliced, there is a need to discard the end slices such as the opposite ends of tomatoes since the end slices are not acceptable for use in the sandwiches, salads, etc.

The prior art includes U.K. Patent Specification 600,131 dated Sep. 28, 1945 discloses a slicer that pushes potatoes or other vegetables through parallel cutter wires to form the potato into a pair of end slices and a plurality of intermediate slices. The end slices are collected separately from the intermediate slices.

U.S. Patent Application 20020170398, publication date Nov. 21, 2002 discloses a slicing device similar to the U.K. potato slicer that simultaneously pushes a plurality of tomatoes or other vegetables or fruit through reciprocating cutting blades.

These and other prior art slicers function to slice tomatoes and possibly other similar edible products into slices of uniform thickness which is desired by most restaurants.

One of the problems with the known prior art slicers is that some tomatoes are so delicate that the slicing, delivery and packing of the tomatoes damages the tomatoes by tending to expel the liquid portions of the tomatoes from the slices and bruising the tomatoes. Another problem is that the prior art slicers appear to be limited to cutting products in a small range of sizes that tends to limit the sizes of products that can be successfully processed by the slicer. Yet another problem of the prior art is that because the cutting blades of the slicer reciprocate during the cutting of the articles, a relatively long span of the cutting blades must be available for the cutting function and the supports for the blades are so far apart that the blades tend to bend or twist during the cutting function and there is a hazard that the fins of the pusher that pass between the blades while pushing the tomatoes will inadvertently engage and damage the blades.

This invention provides the steps of cutting, gathering, and delivery of slices of tomatoes in such a way as to reduce the hazard of deterioration of the tomato slices, such as reducing the amount of liquid loss from the tomato slices and reducing the bruising of the tomato slices, and is useful for performing these functions over a larger size range of tomatoes.

SUMMARY OF THE INVENTION

Briefly described, the present invention provides for improvements to the prior art of article slicing, gathering and delivery of the sliced articles. More particularly, the invention concerns the gentle movement of tomatoes through cutting blades, separating the end slices from the intermediate slices, and then the movement of the intermediate slices from the slicing function to a transfer tray, the gathering the intermediate slices in edge standing attitudes on the transfer tray, and delivering the sliced tomatoes with the transfer tray to a shipping tray or other container, with the tomato slices received in the container in an edge standing, orderly, aligned relationship with one another.

Another aspect of the invention is a method of cutting articles of fruit and the like into an accumulation of multiple parallel slices by placing a plurality of the articles in position on parallel cutting blades with the axes of the articles transverse to the cutting blades, simultaneously pushing the plurality of articles through the cutting blades, and as the articles are pushed through the cutting blades, moving the cutting blades and cutting the articles into parallel slices with each article being sliced into opposed end slices and intermediate slices, separating the opposed end slices of each article from its intermediate slices, depositing the intermediate slices on a transfer tray with the slices oriented in an edge standing attitude, guiding the intermediate slices as they are being deposited on the transfer tray to avoid the intermediate slices of each article from separating and from tilting toward horizontal attitudes when deposited on the transfer tray, gathering the intermediate slices of the plurality of articles on the transfer tray into an accumulation of parallel intermediate slices on the transfer tray with the slices edge standing, moving the transfer tray and the gathered intermediate slices on the transfer tray into juxtaposition above a shipping tray, depositing the gathered slices from the transfer tray to the shipping tray with the slices gathered and oriented vertically, and indexing the shipping tray away from the transfer tray.

Another aspect of the invention is the use of a positioning plate that is installed over the parallel cutting blades of the slicer. The positioning plate has a plurality of positioning openings therein for receiving tomatoes. The positioning openings are oval shaped and are larger in breadth than the tomatoes that are to be received therein but small enough to locate each tomato directly on the cutting blades below. The shape of the positioning openings requires the tomatoes to be oriented in the openings with the longitudinal axis of each tomato transverse to the planes of the cutting blades. Since the sizes of the positioning openings is larger than the tomatoes, the pushers that urge the tomatoes down through the blades do not have to overcome the resistance of a support device that holds the tomatoes away from the blades.

The apparatus includes a plurality of parallel cutting blades spaced from one another for cutting the articles into slices. The blades are oscillated along their lengths during the cycle of cutting the articles, and article pushers are used to push the tomatoes through the moving blades.

An article pusher is used for each article to be cut, and each article pusher includes a plurality of pusher fins sized and shaped to move from a position spaced away from the cutting blades to a position aligned over the cutting blades. Each pusher then moves at a slower velocity downwardly into engagement with the articles resting on the blades to push the articles gently through the cutting blades, and further downwardly between the cutting blades, thereby pushing the articles on through the blades. This results in positively moving all slices of the articles through and beyond the cutting blades, and the articles being cut into slices of uniform thickness.

The faces of the fins of the article pushers may be contoured so as to present an array of fin ends that together form concave pushing surface to the article, tending to stabilize the position of the article as it is urged downwardly through the cutting blades.

If desired, the cutting blades can be arranged with their cutting edges also presenting an array of cutting edges that form concave recess for the purpose of stabilizing the article as the article is being cut.

A transfer tray is positioned beneath the cutting blades a short distance for receiving the sliced articles from the cutting blades substantially without allowing the slices to drop from the cutting blades. This provides for a gentle transfer of the slices, thereby helping to preserve the liquid matter in the tomato slices and tending to avoid bruising of the tomato slices.

Gathering members are positioned at the ends of the transfer tray, and when the slices of the articles are received on the transfer tray the gathering members move toward the center of the transfer tray so as to gently slide the slices together on the transfer tray while still in their edge standing attitude. The gathering of tomatoes in this manner tends to maintain the tomatoes in their upright attitudes even after the gathering members are retracted away from the now gathered tomato slices.

Another feature of the apparatus is the transfer tray that is movable from a position where it receives the tomato slices from the cutter to a lower position juxtaposed the top of a shipping tray for receiving and transporting the intermediate slices of tomatoes. The movement of the transfer tray in this manner tends to reduce the distance of the drops of the tomatoes from the cutting function to the transfer tray and from the transfer tray into the shipping tray, further preserving the liquid in the tomato slices.

Another feature of the invention is the removal of the ends of the tomatoes during the slicing operation. The tomatoes are placed on the cutting blades with the longitudinal axes of the tomatoes extending transversely with respect to the parallel cutting blades, so that the stem end and heel end of the tomatoes are cut away from the intermediate slices of the tomatoes. Receptacles are provided for the ends of the tomatoes, whereupon the ends of the tomatoes can be discarded or used for other purposes and the intermediate slices are retained. The receptacles of the end slices of the tomatoes are shaped and positioned to provide a guide surface against which the adjacent intermediate slices of the tomatoes can bear against in the event of tilting or other lateral movement of the tomato slices as they are moved from the cutting blades to the awaiting transfer tray.

Accordingly, it is an object of this invention to provide an improved method and apparatus for cutting articles such as tomatoes into slices of uniform thickness and delivering the sliced articles from several of the articles in a single shipping tray, with the slices gathered together in a compact, attractive collection of the articles.

It is another object of this invention to provide an improved method and apparatus that delivers several sliced articles to one shipping tray or other container, preferably with the slices of all the articles arranged in parallel edge standing attitude and in face-to-face contact with one another.

Another object of this invention is to provide a system whereby tomatoes can be economically, rapidly, gently and reliably sliced and packaged for delivery to a food service organization, such as fast food restaurants for immediate use and usually without additional preparation.

BRIEF DESCRIPTION OF THE DRAWINGS

FIG. 7 is a perspective illustration of the article slicing apparatus, showing the pushers in their retracted, loading position, showing the front, top and right side thereof.

DETAILED DESCRIPTION

Referring now in more detail to the drawings in which like numerals indicate like parts throughout the several views, FIG. 7 shows a perspective view of the article slicer 60 that simultaneously slices six articles such as tomatoes 10 or other fruits and vegetables, with each article sliced into a pair of end slices and a plurality of intermediate slices. The invention is hereafter described as a tomato slicer, but other articles can be sliced, as may be desired.

Figure 1:
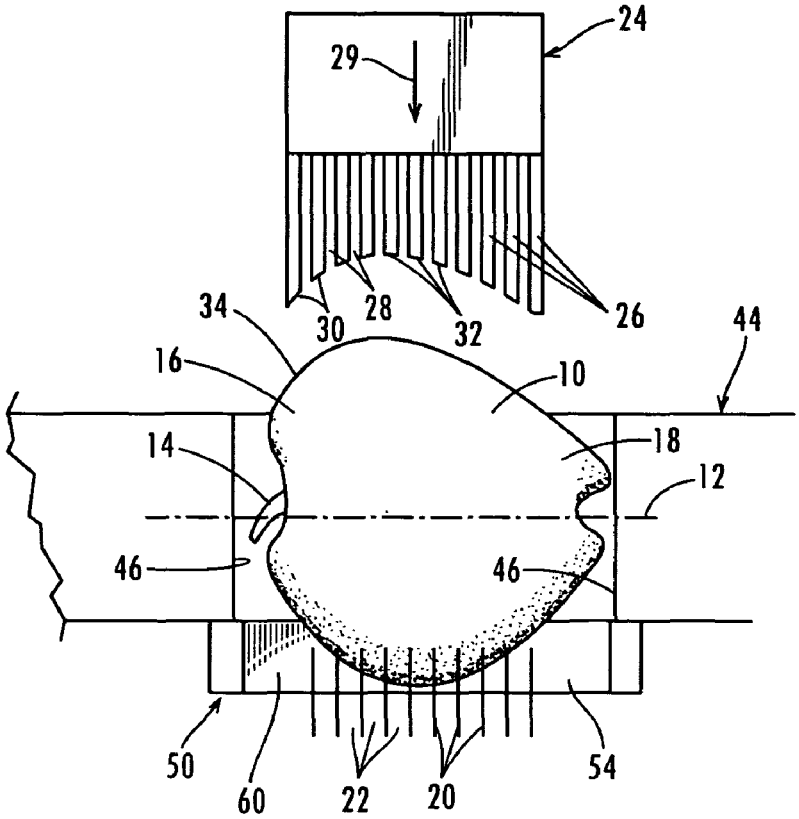
FIG. 1 is a side view of one of the tomatoes that is placed in a positioning opening of a positioning plate upon cutting blades of the slicer, with a pusher in its aligned position over the tomato, just prior to the downward movement of the pusher and the slicing of the tomato.

FIG. 1 shows one cutting station of the article slicer. Tomatoes 10 are placed in the slicer, with each tomato having a longitudinal axis 12, a stem 14, a stem portion 16, and heel portion 18. The stem portion and heel portion are at opposed ends of the tomato, with the axis 12 passing through them. The tomato is placed on a plurality of parallel cutting blades 20 that are spaced apart, as shown by the spaces 22 in FIG. 1.

The cutting blades are mounted on frames, with all of the blades in each frame positioned in the same plane, with first alternate blades mounted on one frame and the second alternate blades mounted on another frame. The frames are oscillated in arcuate paths, moving in opposed directions. The opposite directions oscillation of the alternate blades causes one set of blades to move upwardly while the other set of blades move downwardly, thereby enhancing the cutting function of the blades. This will be described in more detail hereinafter.

Figure 4:
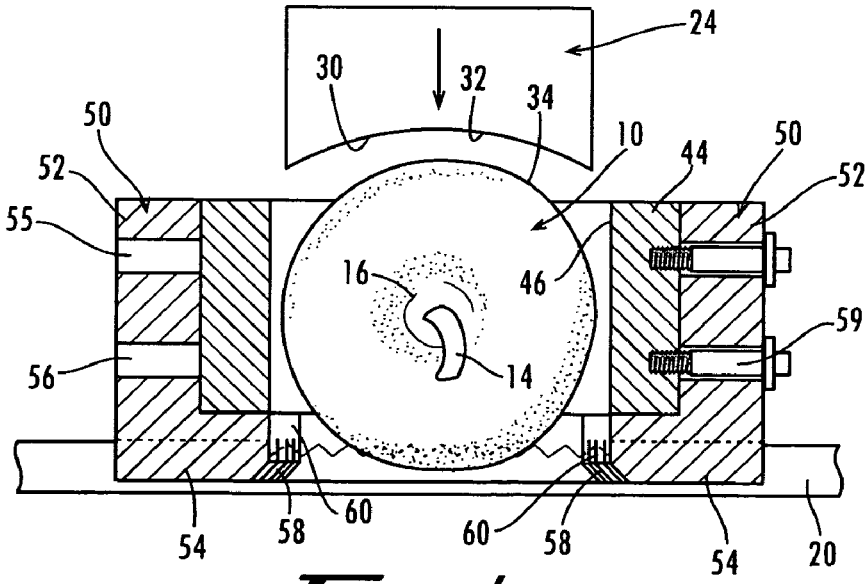
FIG. 4 is an end view of the tomato, and a portion of the positioning plate, cutting blades, and blade guides.
Figure 8:
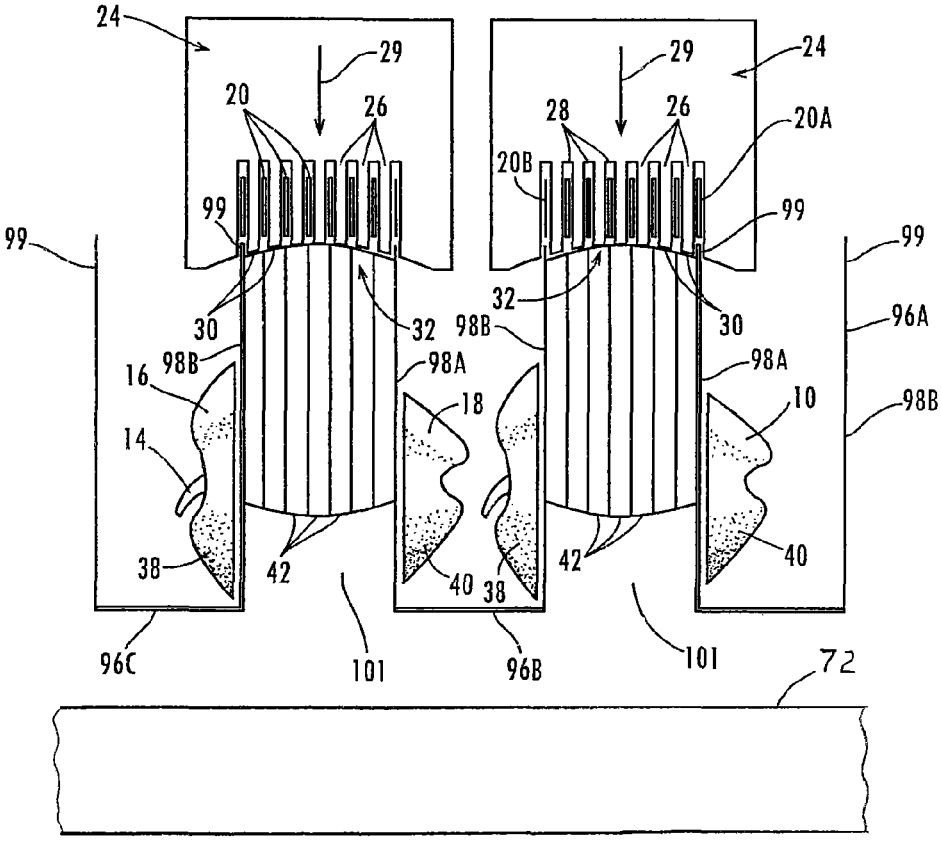
FIG. 8 is a front view of one of the slicing stations of the slicing apparatus, showing the pushers moved downwardly through the cutting blades and the tomatoes just after they have been sliced.

As shown in FIGS. 1, 4 and 8, an article pusher 24 is positioned above each tomato 10 for the purpose of pushing the tomato downwardly through the cutting blades 20. The article pusher includes a plurality of pusher fins 26 that are parallel to and spaced from one another, defining parallel spaces 28 between the fins. The spaces 28 are of sufficient breadth to safely pass about the cutting blades 20 when the pusher is lowered in the downward direction as indicated by arrow 29. The fins are received in the spaces 22 between the cutting blades 20, thereby pushing the sliced tomatoes beyond the cutting blades 20.

In order to make sure that the tomato 10 is properly received and urged through the cutting blades 20, the lower end surfaces 30 of the pusher fins 26 are spaced from one another and face the tomato and are of varied lengths. The array of the lower ends of the fins are contoured so that together they form a generally concave surface 32. This surface is formed so as to approximately match the convex facing surface 34 of the adjacent tomato 10. Thus, when the article pusher 24 is moved downwardly into engagement with the tomato 10, the contoured, concave facing surface 32 of the pusher fins 26 bears against the rounded surface of the tomato, usually spreading its pushing force over a significant surface area of the facing surface of the tomato, thus avoiding damage to the tomato.

The shape of the pushing surface of the fins 26 also tends to initially align the tomato on the cutting blades and then push the tomato downwardly and to hold the tomato in its fixed attitude on the cutting blades 20, without having the tomato slip, rotate or otherwise move transversely with respect to the cutting blades. The thusly stabilized tomato 10 tends to move vertically through and beyond the cutting blades 20, with the pushing surfaces of the fins passing between and beyond the blades so that the tomato 10 is cut into slices that include end slices 38 and 40 and intermediate slices 42. The end slice 38 is the stem slice and the end slice 40 is the heel slice.

Figure 2:
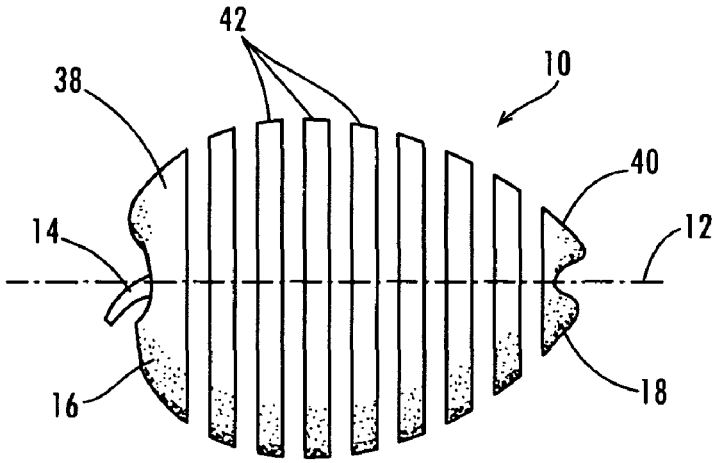
FIG. 2 illustrates a sliced tomato with the slices spread apart for clarity.

As shown in FIGS. 2 and 8, the cutting blades usually are arranged so that the intermediate slices 42 of the tomatoes will be of equal thickness and the end slices 38 and 40 are likely to be somewhat thicker than the intermediate slices. This assures that the intermediate slices are all of acceptable diameter for use at the restaurant and the end slices are not transported to the restaurant, avoiding the food preparer having to discard the end slices.

While FIG. 1 shows the cutting edges of blades 20 all at one height, the blades may be formed of different heights so that the cutting edges of the end cutting blades are somewhat taller than the intermediate cutting blades. This tends to provide a concave support surface for the facing convex surface of the tomato, thereby reducing any tendency of the tomato to move transversely prior to and during the cutting operation.

As shown in FIGS. 1, 3, 4, and 6, article positioning plate 44 is located over the cutting blades 20. A series of article positioning openings 46 are formed in the article positioning plate, one opening for each pusher 24 and its each set of cutting blades 20. The article positioning plate and its openings 46 tend to maintain the tomatoes 10 in a proper alignment on the edges of the cutting blades 20 for slicing. The openings 46 may be formed at a size and shape that corresponds to the size and shape of the tomatoes, with the size of the openings 46 being larger than the anticipated sizes of the tomatoes so that the article pushing plate usually avoids frictionally engaging and avoids supporting the tomatoes. The size of the positioning openings may be selected to be of a breadth great enough for allowing the tomatoes to come into direct contact with the cutting blades under the influence of gravity. But the positioning openings are small enough to surround the tomatoes and confine the tomatoes in the correct location on the blades and in alignment with the pushers 24.

Figure 3:
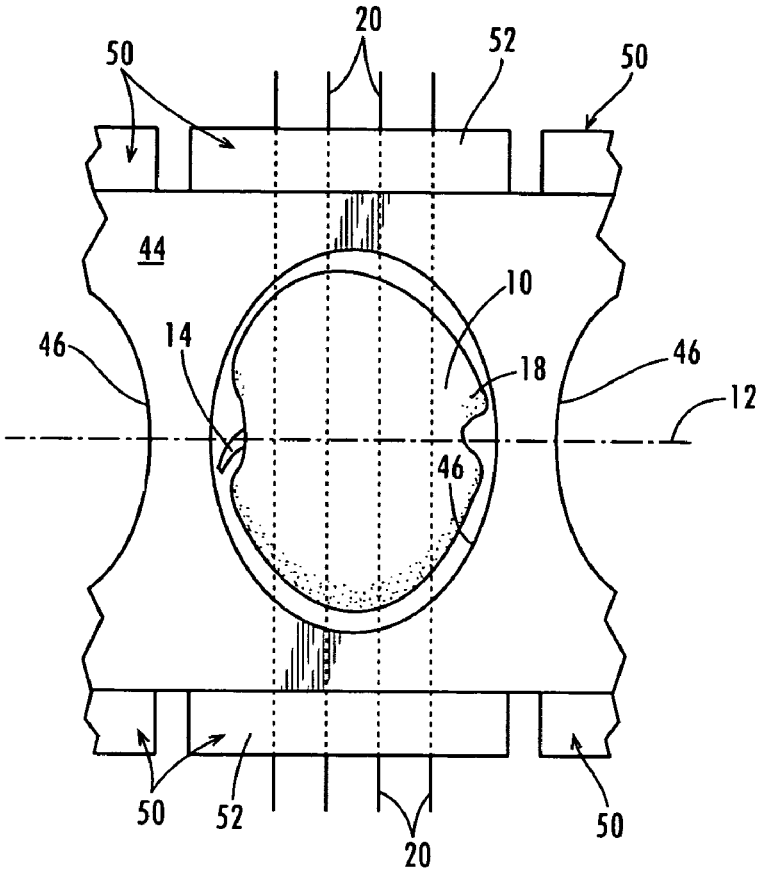
FIG. 3 is a top view of a tomato in a positioning opening of a positioning plate

As shown in FIG. 3, the positioning openings 46 of the positioning plate 44 also may be oval shaped. The oval shape of the openings approximately matches the cross sectional shape of the tomatoes when the tomatoes are placed on their sides with the longitudinal axes of the tomatoes oriented at a right angle with respect to the cutting blades and at a right angle with respect to the long axis of the oval shape of the openings. If a tomato is inadvertently placed in some other attitude in an oval-shaped positioning opening, the tomato usually will not properly fit into the opening, thus alerting the operator of the slicer that the tomato needs to be repositioned in the opening. The oval shape of the positioning openings also tends to assure the tomatoes are always sliced transversely to the longitudinal axis of the tomatoes.

Figure 5:
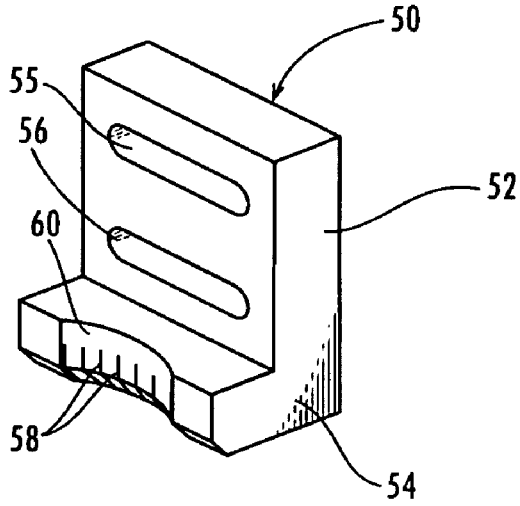
FIG. 5 is a perspective view of a cutting blade guide, showing the front, top and right side of the blade guide.
Figure 6:
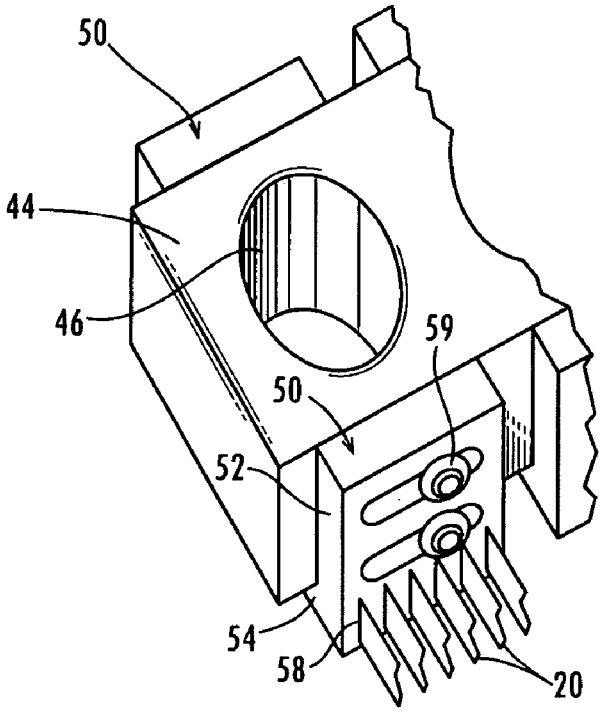
FIG. 6 is a perspective view of a portion of the positioning plate and one of the positioning openings, a cutting blade guide and portions of the cutting blades, showing the top, front and left end thereof.
Figure 1:
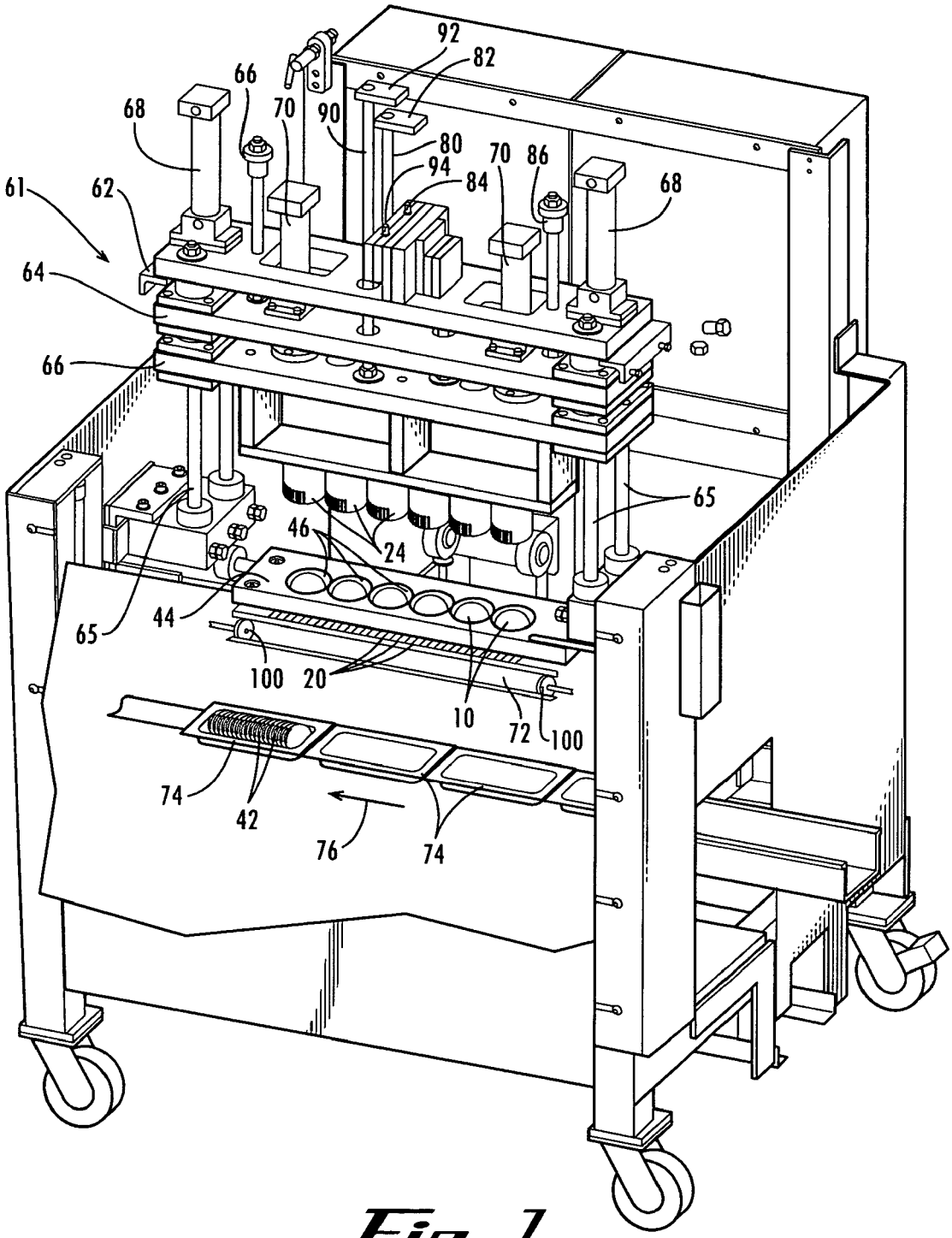

FIGS. 5 and 6 show cutting blade guides 50 that are used to guide the cutting blades 20 during their back and forth oscillations. Blade guides 50 are L-shaped and each includes a vertically oriented, rectangular mounting plate 52, and a horizontally oriented guide plate 54. Mounting plate 52 defines mounting slots 55 and 56 for receiving screws 59 or other connectors, whereas guide plate 54 defines parallel blade guide slots 58 extending across the bottom surface of the guide plate.

As illustrated in FIGS. 4 and 6, cutting blade guides 50 are mounted in pairs on opposite sides of the positioning plate 44 in alignment with article openings 46, with screws or other connector devices 59 extending through the slots 55 and 56 and into the positioning plate 44. This positions the guide plate 54 of the blade guide in abutment with the lower surface of the positioning plate 44 as shown in FIG. 4, with the lengths of the cutting blade guide 58 directed across the article position opening 46.

As shown in FIG. 5, an arcuate wall segment 60 is formed in the guide plate 54 of each cutting blade guide 50. As shown in FIG. 4, the arcuate wall segment 60 is placed coextensive with the interior surface of the position openings 46 of the positioning plate 44.

With this arrangement, when the cutting blades 20 oscillate, their non-longitudinal movements are constrained by the blade alignment slots 58 of the cutting blade guide 50 so that the blades tend to remain in their proper orientation without tilting, bowing, or otherwise deviating from their intended positions. The close placement of the blade alignment slots 58 with respect to the openings 46 assures that the stability of the blades 20 is maintained at least at the edge of the openings 46. This is important so that the fins 26 of the pusher 24 pass between the blades 20 and the spaces 28 between the fins allow the fins to straddle the blades when the pusher moves downwardly and partially through the blades 20.

FIG. 7 illustrates the slicing apparatus 61 that includes a support framework that is not specifically described herein. A stationary support plate 62 is mounted to the frame work, a pusher positioning plate 64 is located below the stationary support plate 62, while pusher cutting plate 66 is located below pusher positioning plate 64. Vertical guide bars 65 extend upwardly from the support framework and support at their upper ends the corners of support plate 62 and extend vertically through corner openings of the pusher positioning plate 64 and pusher cutting plate 66.

Positioning cylinders 68 are mounted to stationary support plate 62 at each end of the plate and are connected to the pusher positioning plate 64 plate for raising and lowering the pusher positioning plate, so that the positioning cylinders 68 can raise and lower the pusher positioning plate 64 along the vertical guide bars 65.

Likewise, cutting cylinders 70 are mounted to the pusher positioning plate 64 and are connected to the pusher cutting plate 66 for raising and lowering the cutting plate with respect to the positioning plate 64, along the vertical guide bars 65.

A plurality of the article pushers 24 are aligned with one another across the framework and are equally spaced apart and are supported by the pusher cutting plate 66, with each article pusher 24 located over and aligned with an article positioning opening 46 of the article positioning plate 44 and its cutting blades 20 for receiving an article, such as a tomato 10, therein.

Transfer tray 72 is positioned below the cutting blades 20, with the cutting blades 20 being positioned below the article positioning plate 44. Containers 74 are indexed beneath the transfer tray 72, from right to left as indicated by arrow 76 in FIG. 7.

Figure 9:
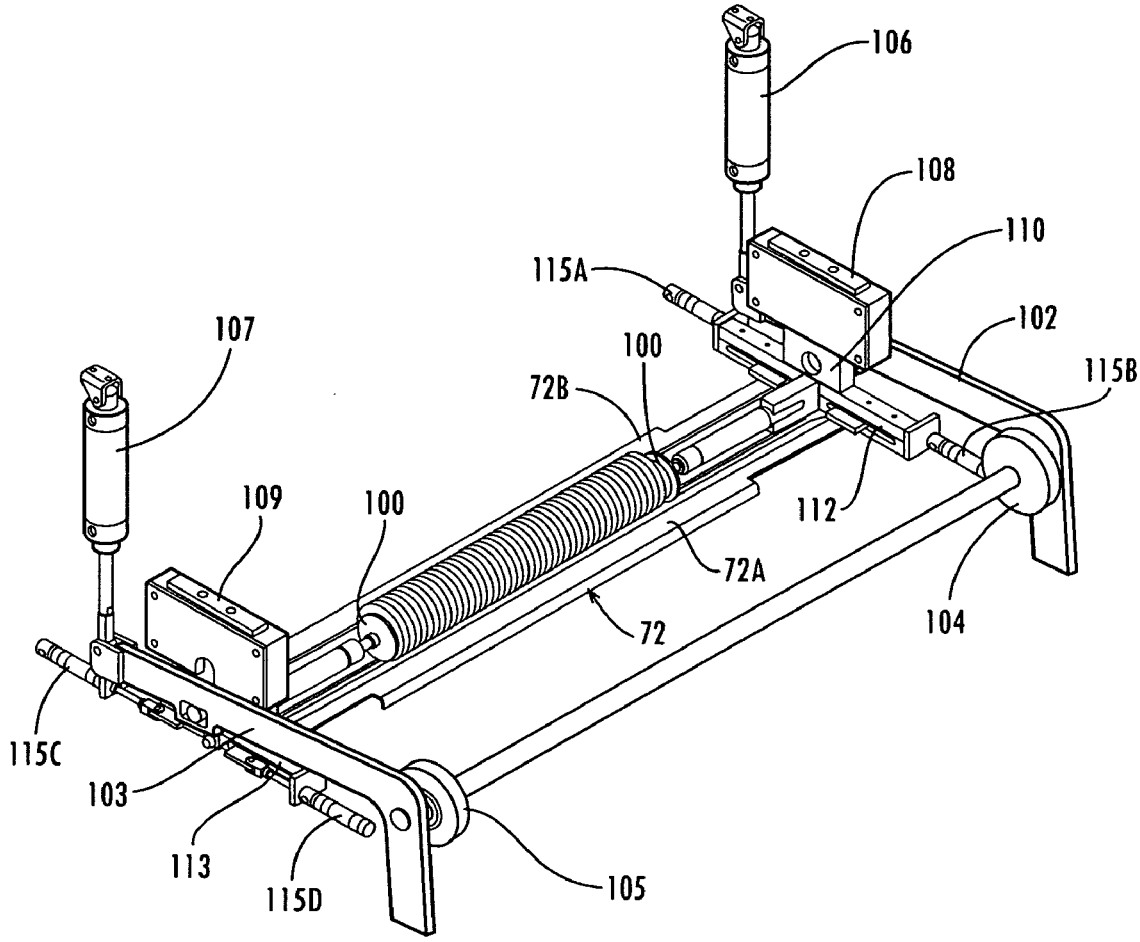
FIG. 9 is a perspective view of the transfer tray and the gatherer, showing the top, front and left side thereof.

FIG. 9 shows the mechanical actuators for the transfer tray 72. L-shaped support arms 102 and 103 are mounted to bearings 104 and 105, and lifting cylinders 106 and 107 operate to oscillate the distal ends of the lifting arms about the bearings. When the lifting cylinders 106 and 107 are actuated to distend their cylinder rods, the ends of the L-shaped support arms 102 and 103 move downwardly and the transfer tray 72 moves downwardly.

In the meantime, in order that transfer tray 72 move only vertically, guides 108 and 109 that are supported in a stationary position on opposite sides of the transfer tray have their guide blocks 110 (only one shown) that are confined to vertical movement. The guide blocks are connected to the tray support bars 112, 113. The transfer tray 72 comprises two tray sections, 72A and 72B that are movable apart, forming a center opening there between that allows the tomato slices to move downwardly from the transfer tray under the influence of gravity. The ends of the two tray sections are supported by the tray support bars 112 and 113. Cylinders 115A-115D are connected to the tray support bars 112 and 113 for controlling the tilting movement of the tray sections 72A and 72B.

Gathering plates 100 are also supported by their cylinders to the tray support bars 112 and 113 so that the gathering plates are maintained in alignment with the slices of tomatoes when the slices are resting in edge standing attitude in the transfer tray before the slices are deposited from the transfer tray 72 into the awaiting shipping tray 74.

Figure 10:
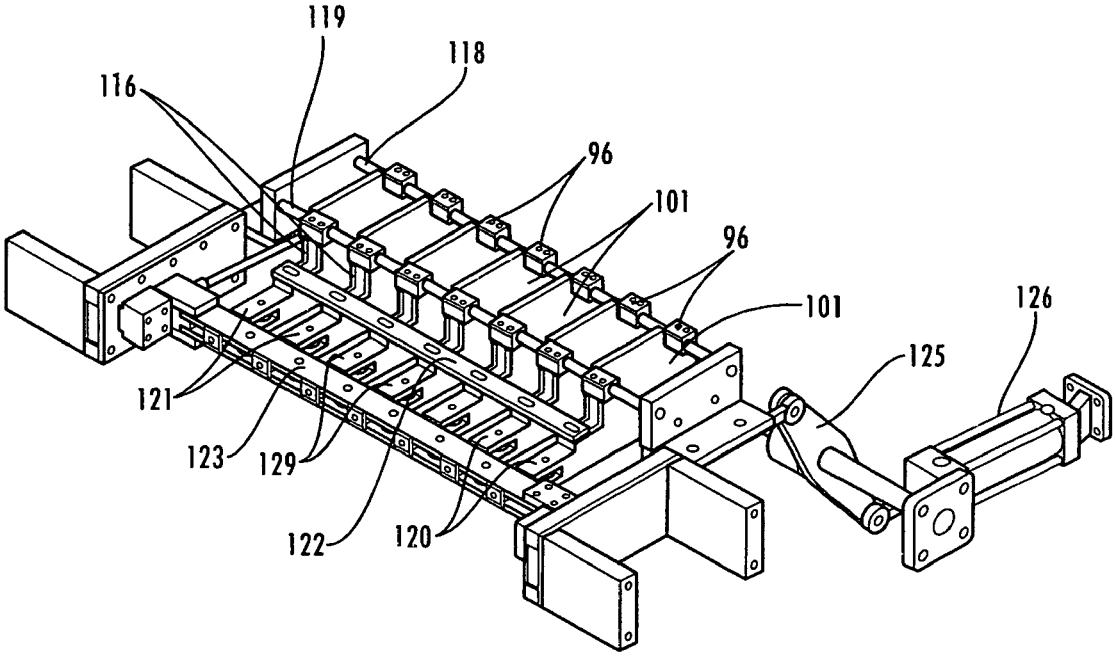
FIG. 10 is a perspective view of the end slices ejector.

FIG. 10 illustrates the end collectors 96 that collect and eject the end slices of the tomatoes away from the intermediate slices. The end collectors are spaced from one another and form vertical passages 101 therebetween for allowing the downward movement of the intermediate slices of the tomatoes. The end collectors 101 are suspended in place on a pair of parallel horizontal support bars 118 and 119.

An ejector 120 is aligned with and is movable through each of the end collectors 96. Each ejector 120 has a horizontal guide plate 121 that slides through a stabilizer bar 122, and the other ends of the horizontal guide plates are mounted to a laterally reciprocating bar 123. A crank 125 that is operated by cylinder 126 functions to oscillate the laterally reciprocating bar 123 toward and away from the end collectors 96 so that the upright plates 116 of each ejector moves longitudinally through an end collector 96, thereby displacing and discharging the end of a tomato or other article that has been received in the end collector.

Operation

In operation, the beginning of an article slicing procedure has the positioning plate 64 and cutting plate 66 raised as illustrated in FIG. 7, so that the article pushers 24 are spaced high above the article positioning plate 44. A conventional pick and place machine (not shown) or a worker places tomatoes 10 in the article openings 46 of the article positioning plate 44, with the longitudinal axes 12 (FIG. 1) of the tomatoes oriented transversely with respect to the cutting blades 20.

Once the tomatoes are placed in the article openings 46, the worker removes his/her hands from the vicinity of the moving components of the apparatus to remotely positioned safety switches and actuates the switches. This results in first the positioning plate 64 being rapidly moved downwardly by positioning cylinders 68 so as to place the cutting plate 66 and the article pushers 24 closer to the tomatoes. Position indicator bar 80 is mounted to the positioning plate 64 and extends up through an opening in the stationery support plate 62, so that its lateral protrusion 82 actuates a switch 84 which terminates the downward movement of the positioning plate 64 and cutting plate 66. In the meantime, stopper rods 86 move in unison with the positioning plate 64 and function to engage stationary plate 62 and terminate the downward movement of the positioning plate 64 in the event the amplitude of movement of the positioning plate is excessive.

Once the switch 84 is actuated, the operation of positioning cylinders 68 is terminated and the downward movement of the positioning plate 64 stops. This places the article pushers 24 in aligned positions above the tomatoes 10 and their respective article openings 46. Also, when the switch 84 has been actuated, this begins the operation of the cutting cylinders 70 to lower the cutting plate 66 with respect to the pusher positioning plate 64 to begin the downward movement of the article pushers 24 against the facing surfaces of the tomatoes 10, to push the tomatoes into and through the cutting blades 20. In the meantime, the cutting blades begin their oscillation when the pushers begin to push against the tomatoes and perform their cutting of the tomatoes into slices.

Once the pusher fins 26 of the article pushers 24 have projected between and beyond the cutting blades 20 and the tomato has been completely sliced and removed from the cutting blades, the second position indicator bar 90 moves its lateral protrusion 92 into contact with switch 94, which reverses the motion of the cutting cylinder 70 and positioning cylinder 68, thereby rapidly lifting the article pushers 24 from the cutting blades 20 up to the loading position, displaced from the cutting blades 20.

When the positioning plate 64 and cutting plate 66 have been moved to their respective down positions, as shown in FIG. 8, the article pushers 24 will have moved the lower ends of the their pusher fins 26 completely beyond the cutting blades 20, thereby assuring that the tomatoes are separated from the cutting blades.

FIG. 8 shows the tomatoes immediately after they have been pushed through the cutting blades 20 by the pusher fins 26. End collectors 96A, 96B, 96C, etc. are positioned below and intermediate the article pushers 24. The end collectors each include side walls 98A and 98B that have upper edge portions 99 that are aligned with the end cutter blades 20A and 20B. With this arrangement, when the end cutter blades 20A and 20B cut the end slices 38 and 40 from the rest of the tomato, the end slices 38 and 40 move on the other side of the side walls 98A and 98B from the intermediate slices 42, so that the end slices are collected separately from the intermediate slices. The intermediate slices continue to move downwardly through the vertical passage 101 between the side walls 98A and 98B toward the transfer tray 74. The ejectors 120 (FIG. 10) are used to laterally engage against the end slices 38 and 40 to eject the end slices from the end collectors 96. The ejection of the end slices can be performed by other means, such as by a blast of air. In the meantime, the other cutting blades 20 will have cut through the intermediate portion of the tomatoes, forming the intermediate slices 42.

It will be noted that the intermediate slices 42 pass through the vertical passage 101 closely adjacent the exterior surfaces of the side walls 98A and 98B of the end collectors 96 so that the side walls tend to contain the intermediate slices 42 together, keeping the intermediate slices from separating. It will be noted that, contrary to FIG. 2, the natural tendency of the intermediate slices that leave the cutting blades 20 tend to re-contact one another and reform themselves in a rounded configuration. Thus, the intermediate slices 42 tend to move together to the awaiting transfer tray 72.

As shown in FIG. 9, transfer tray 72 is movable vertically by its cylinders 106 and 107, to an up position where it is located closely adjacent the bottoms of the end collectors 96, for immediately receiving the lower portions of the intermediate slices of the tomatoes, just after the upper portions of the intermediate slices leave the cutting blades and before the upper portions of the tomatoes leave the vicinity of the side walls 98A and 98B, so that the bottoms of the intermediate slices of the tomatoes become supported before they leave the confines of the side walls 98A and 98B.

The transfer tray 72 is raised and lowered during the cutting cycle. The transfer tray 72 is raised toward the cutting station to reduce the distance of movement of the slices from the cutting station to the transfer tray, to avoid dropping the intermediate slices of the tomatoes to the transfer tray a distance that would tend to disturb the arrangement of the slices or bruise the tomato slices or to lose the liquid in the slices.

Once the transfer tray 72 has received its sliced tomatoes, it is lowered for bringing the intermediate slices of the tomatoes in a downward direction from the slicing function toward the containers 74 and then opened to deposit the sliced tomatoes in a container 74.

In the meantime, gathering plates 100 (FIG. 9) that are aligned with the transfer tray 72 move toward each other along the length of the transfer tray so as to urge the separate groups of intermediate slices from each tomato toward a discharge position, usually at the center of the tray, thereby gathering the intermediate slices of the tomatoes of the several tomatoes in a smaller length that corresponds to the length of the cavity of the shipping container 74. The transfer tray is formed in two parts that move together to form a trough that receives the tomato slices and that move apart to allow the slices to move to containers 74 with minimum of disturbance. When the halves of the tray are tilted open, the tray is positioned less than one inch above the container 74, usually about $\frac{1}{4}^{th}$ inch, so that the tomatoes tend to move gently from the transfer tray 72 downwardly into the cavities of the containers 74, thereby minimizing the loss of any liquid from the sliced tomatoes and avoiding bruising of the tomatoes.

Figure 11:
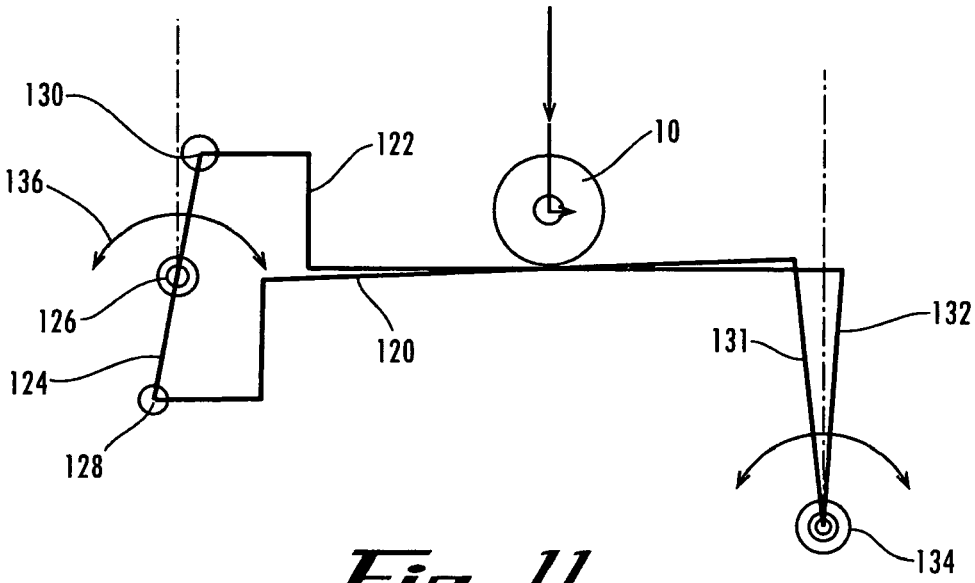
FIG. 11 is a schematic illustration of the cutting blade frames, showing how alternate ones of the blades the blades oscillate in opposed directions.

FIG. 11 is a schematic illustration of the movements of the frames of the cutting blades. As previously stated, the cutting blades are mounted on a pair of frames, with all the blades in each frame positioned in the same plane, with the first alternate blades mounted on one frame and the second alternate blades mounted on another frame.

As shown in FIG. 11, the left ends of frames 120 and 122 are mounted at opposite ends of a oscillating drive arm 124. Oscillating drive arm 124 is pivotal intermediate its ends at axle 126, with oscillating frame 120 connected to the lower end 128 of the arm 124, and the oscillating frame 122 connected at the upper end 130.

The other ends of the cutting blade frames 120 and 122 are mounted on levers 131 and 132, and the levers are pivotally mounted on axle 134. Tomatoes 10 are placed on the cutting blades of frames 120 and 122, with the longitudinal axes of the tomatoes oriented at a right angle with respect to the planes of the blades.

As the oscillating drive arm 124 oscillates as indicated by the double-headed arrow 136, the lower end 128 of the oscillating drive arm moves from dead center through an upward arc, while the upper end 130 moves from dead center through a downward arc. This causes the cutting blade frame 120 to move upwardly while the cutting blade frame 122 moves downwardly. This changes the elevations of the blades as the blades oscillate, so that alternate ones of the blades move upwardly while the other alternate blades move downwardly. This tends to cause every other blade to cut more aggressively than the other alternate blades as they move upwardly. This enhances the cutting function of the blades, allowing the tomatoes to be cut with the use of less pushing force applied to the tomatoes, thereby tending to preserve the tomatoes with less compression force as the cutting function proceeds.

Although a preferred embodiment of the invention has been disclosed in detail herein, it will be obvious to those skilled in the art that variations and modifications of the disclosed embodiment can be made without departing from the spirit and scope of the invention as set forth in the following claims.

We claim:

1. A method of cutting articles into an accumulation of multiple parallel slices, the articles having opposed stem portions and heel portions and a longitudinal axis extending through the stem portion and the heel portion, comprising:

placing a plurality of the articles in position on cutting blades in parallel planes with the axes of the articles transverse to the cutting blades, after the articles have been placed on the cutting blades, moving article pushers into engagement with the articles and pushing the plurality of articles with the pushers through the cutting blades, as the articles are pushed through the cutting blades, moving the cutting blades and cutting the articles into parallel slices with each article being sliced into opposed end slices and intermediate slices, separating the opposed end slices of each article from its intermediate slices, depositing the intermediate slices on a transfer tray with the slices oriented in edge standing attitude, guiding the intermediate slices as they are being deposited on the transfer tray to avoid the intermediate slices of each article from separating and from tilting toward horizontal attitudes when deposited on the transfer tray, receiving the lower portions of the intermediate slices on the transfer tray before the upper portions of the slices are no longer guided, moving the transfer tray without opening the transfer tray away from the cutting blades into juxtaposition above a shipping tray to reduce the distance between the gathered intermediate slices and the shipping tray, between when the lower portions of the intermediate slices are received on the transfer tray and when the intermediate slices are deposited in the shipping tray and after the transfer tray has moved away from the cutting blades, gathering the intermediate slices of the plurality of articles on the transfer tray into an accumulation of parallel intermediate slices on the transfer tray with the slices oriented in edge standing attitude, after the transfer tray and the gathered intermediate slices have been moved away from the cutting blades and into juxtaposition above the shipping tray, opening the transfer tray and depositing the gathered slices from the transfer tray to the shipping tray with the slices gathered and oriented in edge standing attitude, and indexing the shipping tray away from the transfer tray.

2. The method of claim 1, wherein the step of separating the opposed end slices from the intermediate slices comprises collecting the end slices into end slice collectors, and the step of guiding the intermediate slices comprises guiding the intermediate slices with the end slice collectors until the intermediate slices are delivered to the transfer tray.

3. The method of claim 1, wherein the step of moving the transfer tray comprises moving the transfer tray downwardly from the cutting blades toward the shipping tray while maintaining the intermediate slices on the transfer tray.

4. The method of claim 1, wherein the step of moving the transfer tray comprises reciprocating the transfer tray vertically between the cutting blades and the shipping tray.

5. The method of claim 1, wherein the step of cutting the articles into parallel slices includes cutting the opposed end slices in a thickness to include the stem portion and the heel portion.

6. The method of claim 1, wherein:

the step of placing a plurality of the articles in position on parallel cutting blades comprises placing the articles in an articles positioning member that maintains the articles in contact with the cutting blades without holding the articles off the cutting blades.

7. The method of claim 6, wherein each article pusher has a plurality of fins, with each fin sized to move between adjacent cutting blades and each fin spaced from adjacent fins a distance sufficient to span a cutting blade, and the fins of each article pusher together forming a concave article engaging surface for engaging the convex outer surfaces of the articles, wherein the step of simultaneously pushing the plurality of articles through the cutting blades includes pushing the articles with the concave article engaging surface.

8. The method of claim 1, wherein the step of depositing the intermediate slices on a transfer tray comprises pushing the articles until the slices engage the transfer tray.

9. The method of claim 1, and further including the step of supporting the cutting blades immediately adjacent the position where the cutting blades cut the articles.

10. A method of forming articles into an accumulation of a plurality of intermediate parallel slices, comprising:

moving the articles through downward paths through a plurality of cutting blades in parallel planes to form the articles into opposed end slices and intermediate slices, separating the opposed end slices from the intermediate slices in end collectors having side walls positioned adjacent the downward paths of the intermediate slices, retrieving the intermediate slices in edge standing attitude in a transfer tray just after the upper portions of the intermediate slices leave the cutting blades and before the upper portions of the tomatoes leave the vicinity of the side walls of the end collectors, lowering the transfer tray with the retrieved slices in the transfer tray away from the cutting blades to a position juxtaposed the upwardly facing opening of a shipping tray without opening the transfer tray, between when the lower portions of the intermediate slices are received on the transfer tray and when the intermediate slices are deposited in the shipping tray and after the transfer tray has moved away from the cutting blades gathering the intermediate slices of the plurality of articles on the transfer tray into an accumulation of parallel slices on the transfer tray, after the retrieved slices have been lowered from the cutting blades into juxtaposition with the shipping tray, opening the transfer tray and depositing the retrieved slices from the transfer tray into the shipping tray.

11. The method of claim 10, wherein the step of moving the articles downwardly through a plurality of parallel cutting blades comprises lowering a pusher for each article at a first speed from an articles loading position spaced away from the cutting blades for making room to load the articles on the cutting blades into aligned positions close above each article, in response to the pushers reaching the aligned positions moving the pushers against the articles at a second speed less than the first speed to urge the articles gently and simultaneously through the cutting blades with the pushers moving part way through the cutting blades, and retracting the pushers back from the cutting blades to the loading position spaced away from the cutting blades.

12. A method of forming a plurality of articles into an accumulation of a plurality of intermediate parallel slices of the articles, comprising:

moving the articles in downward paths through a plurality of cutting blades in parallel planes to form the articles into opposed end slices and intermediate slices, separating the opposed end slices from the intermediate slices in end collectors positioned adjacent the downward paths of the intermediate slices, retrieving the intermediate slices in edge standing attitude in a transfer tray just after the upper portions of the intermediate slices leave the cutting blades and before the upper portions of the tomatoes leave the vicinity of the end collectors, supporting the intermediate slices of each article in edge standing attitude on the transfer tray, lowering the transfer tray away from the cutting blades to a position juxtaposed the upwardly facing opening of a shipping tray, between when the lower portions of the intermediate slices are received on the transfer tray and when the intermediate slices are deposited in the shipping tray and after the transfer tray has moved away from the cutting blades gathering the intermediate slices of the plurality of articles on the transfer tray into an accumulation of parallel slices on the transfer tray, and after the retrieved slices have been lowered from the cutting blades into juxtaposition with the upwardly facing opening of the shipping tray, opening the transfer tray and depositing the retrieved slices from the transfer tray into the shipping tray.

* * * * *